US007597577B1

(12) United States Patent
Huang et al.

(10) Patent No.: US 7,597,577 B1
(45) Date of Patent: Oct. 6, 2009

(54) ELECTRIC SOCKET CAPABLE OF SECURING PLUG

(76) Inventors: Fu-Hsiang Huang, No.116, Ging Zai Lane, Sec. 3, Zhongshan Rd., Wuri Shiang, Taichung County 414 (TW); Chih-Yi Wang, 7F.-1, No.137-1, Fushun Rd., Xitun District, Taichung City 407 (TW); Kuo-Tien Wang, No.3, Lane 80-19, Zhongyong Rd., Nantun District, Taichung City 408 (TW); Yu-Hsuan Huang, 6F.-2, No.113, Shizheng N. 3RD Rd., Xitun District, Taichung City 407 (TW)

( * ) Notice: Subject to any disclaimer, the term of this patent is extended or adjusted under 35 U.S.C. 154(b) by 0 days.

(21) Appl. No.: 12/180,154

(22) Filed: Jul. 25, 2008

(30) Foreign Application Priority Data

Jun. 23, 2008 (TW) ..... 97123403 A

(51) Int. Cl.
*H01R 13/627* (2006.01)

(52) U.S. Cl. ..... 439/354

(58) Field of Classification Search ..... 439/354, 439/137, 107, 188, 138, 135, 140, 353, 74, 439/171, 131

See application file for complete search history.

(56) References Cited

U.S. PATENT DOCUMENTS 7,104,818 B1 * 9/2006 Chang ..... 439/140
7,344,385 B2 * 3/2008 Chen ..... 439/74
7,445,472 B1 * 11/2008 Huang et al. ..... 439/138

* cited by examiner

*Primary Examiner*—Edwin A. Leon
(74) *Attorney, Agent, or Firm*—Browdy and Neimark P.L.L.C.

(57) ABSTRACT

An electric socket includes an insulating main member, two check securing devices, and a release device. The insulating main member has apertures thereon and electrodes behind the apertures. The check securing device is provided in the insulating main member having a suspended flexible section sloping toward a bottom end of the aperture. When a plug has prongs inserted into the apertures, the prongs will bend the flexible section of the check securing device inwards. An interference condition will be occurred between the prong and the flexible section when the plug is pulled out. The release device is provided on the insulating main member for manipulation. The release device has a arm pressing the flexible section of the check securing device bending inwards when it is pressed for releasing the interference condition between the prong and the flexible section.

6 Claims, 5 Drawing Sheets

ELECTRIC SOCKET CAPABLE OF SECURING PLUG

BACKGROUND OF THE INVENTION

1. Field of the Invention

The present invention relates to an electric socket and more particularly, to an electric socket capable of securing a plug inserted therein.

2. Description of the Related Art

In everyday life, the application of plugs and sockets is very common. Typically, a conventional socket has an insulating main member, on which two or three apertures are provided, and electrodes therein associated with the apertures. A conventional plug has two or three prongs to be inserted into the apertures of the socket and contact the electrodes.

When the plug is inserted into the socket, the prongs will bend the electrodes that the electrodes may hold the prongs to restrict the plug on the socket. After a long time of use, the restriction will be less and less because of metal fatigue of electrodes therefore the plug will always loose from the old socket. In addition, it usually happens that we kick the wire and makes the plug loosing. If it were happened in a factory, it will shut down machines unexpectedly and make a huge damage.

To fix that problem, some electric sockets provide a function of securing the plug inserted therein. These kinds of electric sockets usually have complex securing structures and complex operating modes.

SUMMARY OF THE INVENTION

The primary objective of the present invention is to provide an electric socket, which may secure a plug inserted therein in a simple structure and in an easier operating mode.

To achieve this objective of the present invention, an electric socket of the present invention includes an insulating main member, at least a check securing device, and a release device. The insulating main member has apertures thereon and electrodes behind the apertures. The check securing device, which is provided in the insulating main member, has a suspended flexible section sloping toward a bottom end of the aperture, which has a free end thereof received in the aperture. When a plug has prongs inserted into the apertures, the prongs will bend the flexible section of the check securing device inwards, and an interference condition will be occurred between the prong and the flexible section when the plug is pulled out. The release device is provided on the insulating main member for manipulation. The release device may press the flexible section of the check securing device for releasing the interference condition between the prong and the flexible section.

DETAILED DESCRIPTION OF THE INVENTION

Figure 1:
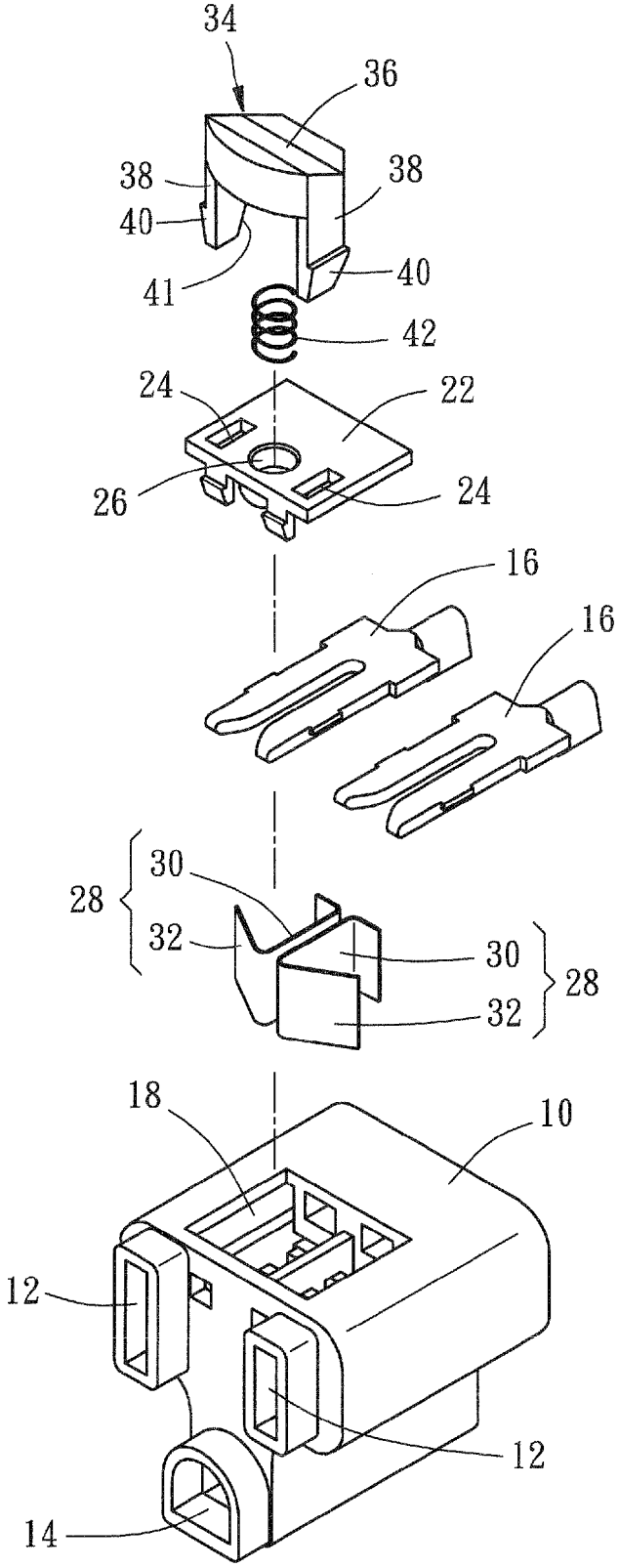
FIG. 1 is an exploded view of a preferred embodiment of the present invention.
Figure 2:
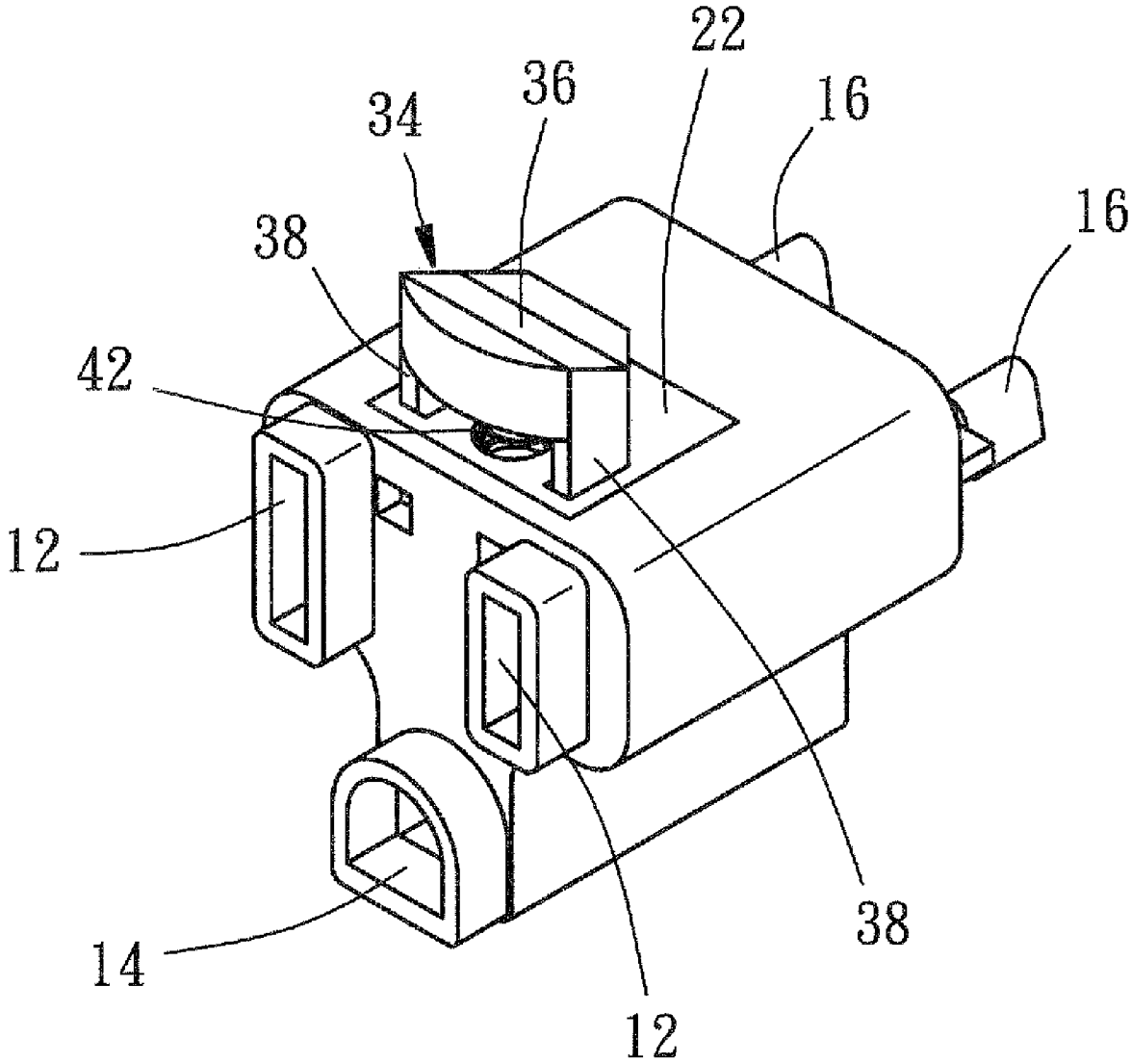
FIG. 2 is a perspective view of the referred embodiment of the present invention.
Figure 3:
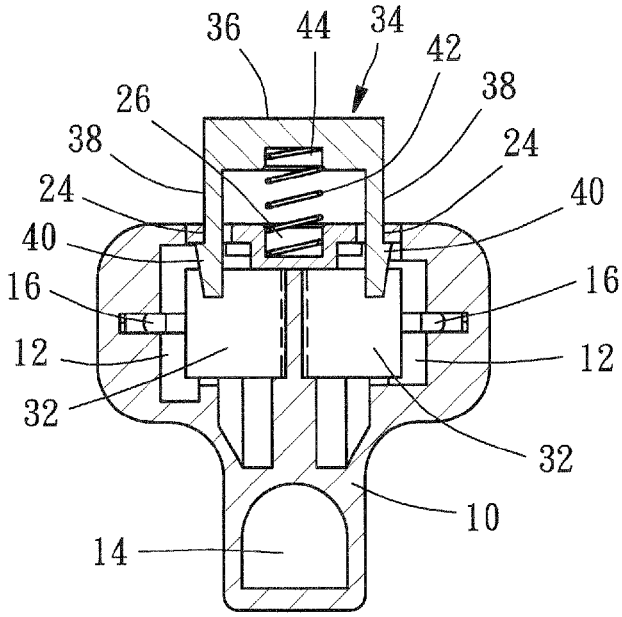
FIG. 3 is a sectional view of the referred embodiment of the present invention, showing the release device.
Figure 4:
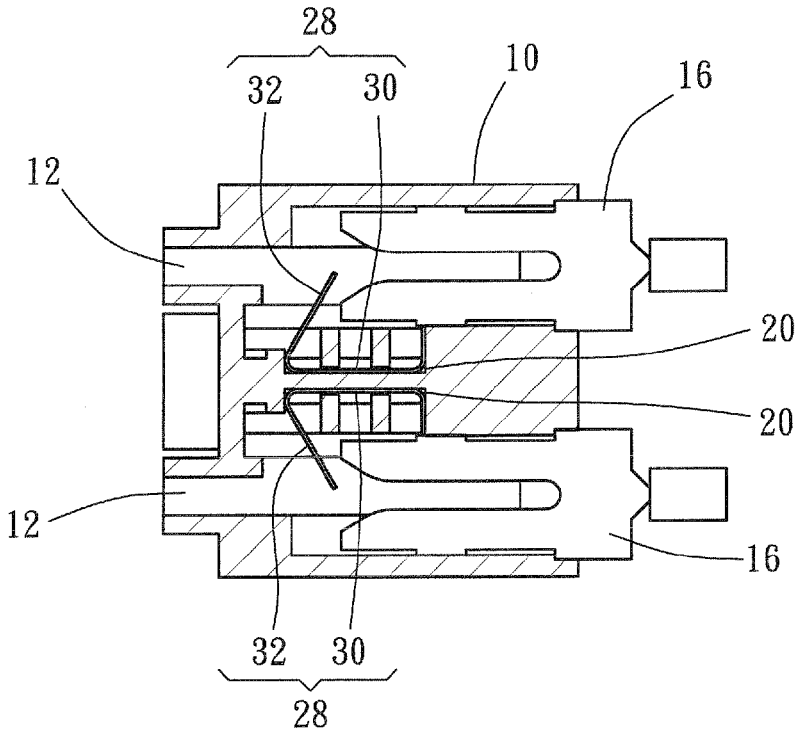
FIG. 4 is a sectional view of the referred embodiment of the present invention, showing the check securing devices.

Referring to FIGS. 1~4, an electric socket of the preferred embodiment of the present invention mainly includes an insulating main member 10, two check securing devices 28, and a release device 34.

The insulating main member 10 has three apertures 12, 14 on a front side thereof, wherein the aperture 14 is ground. Three electrodes 16 are provided behind the apertures 12, 14 respectively to connect wires (not shown). The insulating main member 10 has a bore 18 on a top side thereof communicated with the apertures 12 and two L-shaped slots 20 under the bore 18 and between the apertures 12. A lid 22 is provided to close the bore 18, which has two holes 24 and a recess 26 between the holes 24.

The check securing devices 28 are two metal plates, each of which has a base section 30 and a flexible section 32. The base sections 30 of the check securing devices 28 are inserted into the L-shaped slots 20 of the insulating main member 10 to have the flexible sections 32 suspended. Free ends of the flexible sections 32 are received in the apertures 12 respectively. The flexible sections 32 slope toward inner ends of the apertures 12 to be bent inwards. The free ends of the flexible sections 32 are not smooth, which means the flexible sections 32 have rough free ends.

The release device 34 has a manipulative portion 36 and two arms 38 on a back side of the manipulative portion 36. Each of the arms 38 has a hook 40 and an inclined face 41 beside the hook 40. The arms 38 enters the insulating main member 10 via the holes 24 of the lid 22, and the manipulative portion 36 is left out of the insulating main member 10. The arms 38 are located right above the apertures 12 respectively and will enter the apertures 12 when the manipulative portion 36 is pressed. A spring 42 is provided between the release device 34 and the insulating main member 10 with opposite ends thereof received in a recess 44 on the back side of the manipulative portion 36 and the recess 26 of the lid 22.

Figure 5:
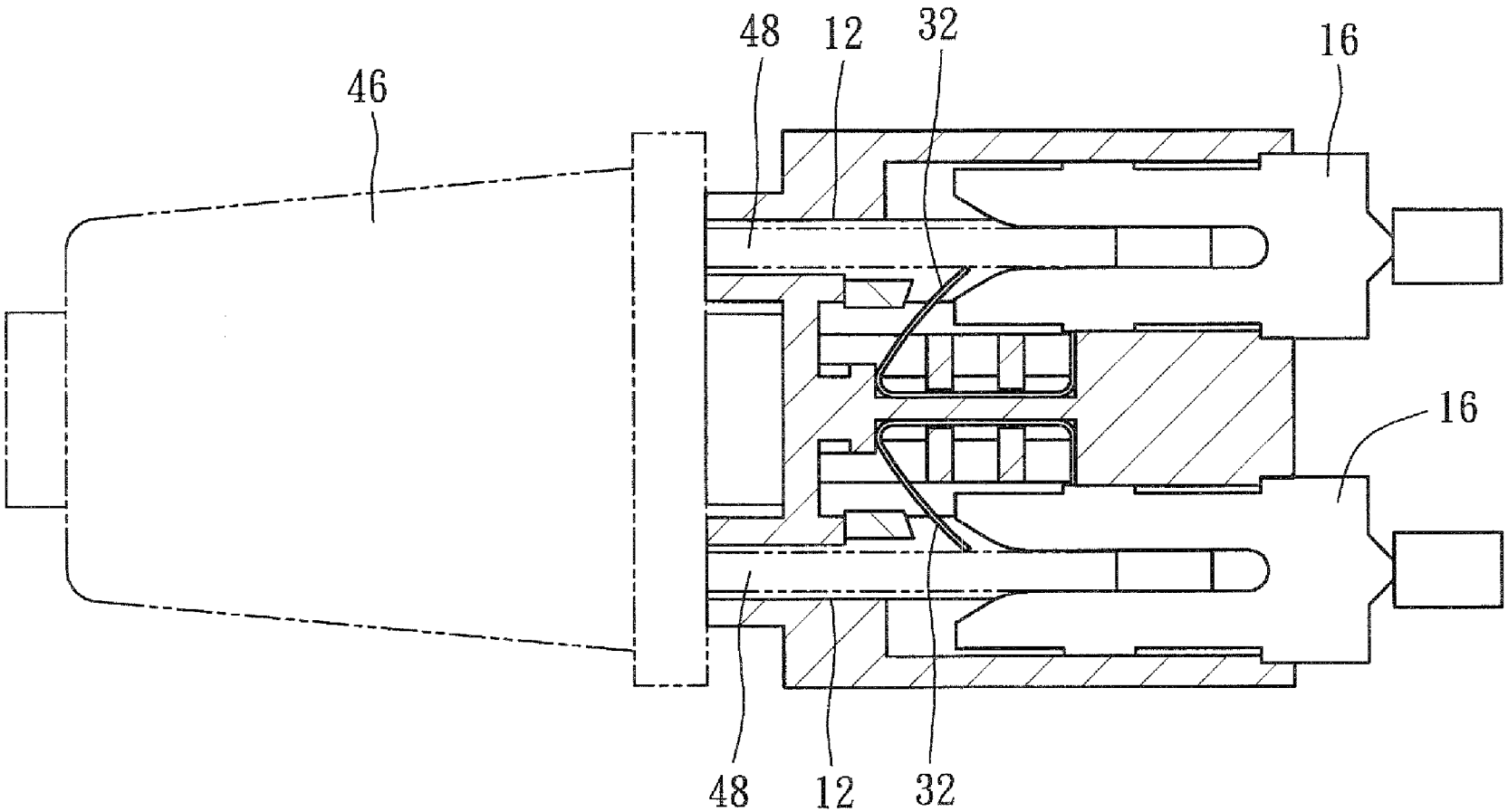
FIG. 5 is a sectional view of the referred embodiment of the present invention, showing the action of the check securing devices on the prongs.

As shown FIG. 5, when a plug 46 is inserted into the electric socket of the present invention, prongs 48 of the plug 46 will enter the apertures 12 to bend the flexible sections 32 of the check securing devices 28 inwards that the free ends of the flexible sections 32 will leave the apertures 28 to allow the prongs 48 go through and contact the electrodes 16. In this condition, if one pulls the plug 46, the prongs 48 tend to be moved backwards that the free ends of the flexible sections 32 of the check securing devices 28 will be moved outwards by the prongs 48 to enter the apertures 12 again. Because of the sloping directions of the flexible sections 32 of the check securing devices 28, an interference condition will be occurred between the flexible sections 32 and the prongs 48 to jam the prongs 48. The greater strength the plug 46 is pulled, the greater interference condition is occurred that one may not pull the plug 46 out.

Figure 6:
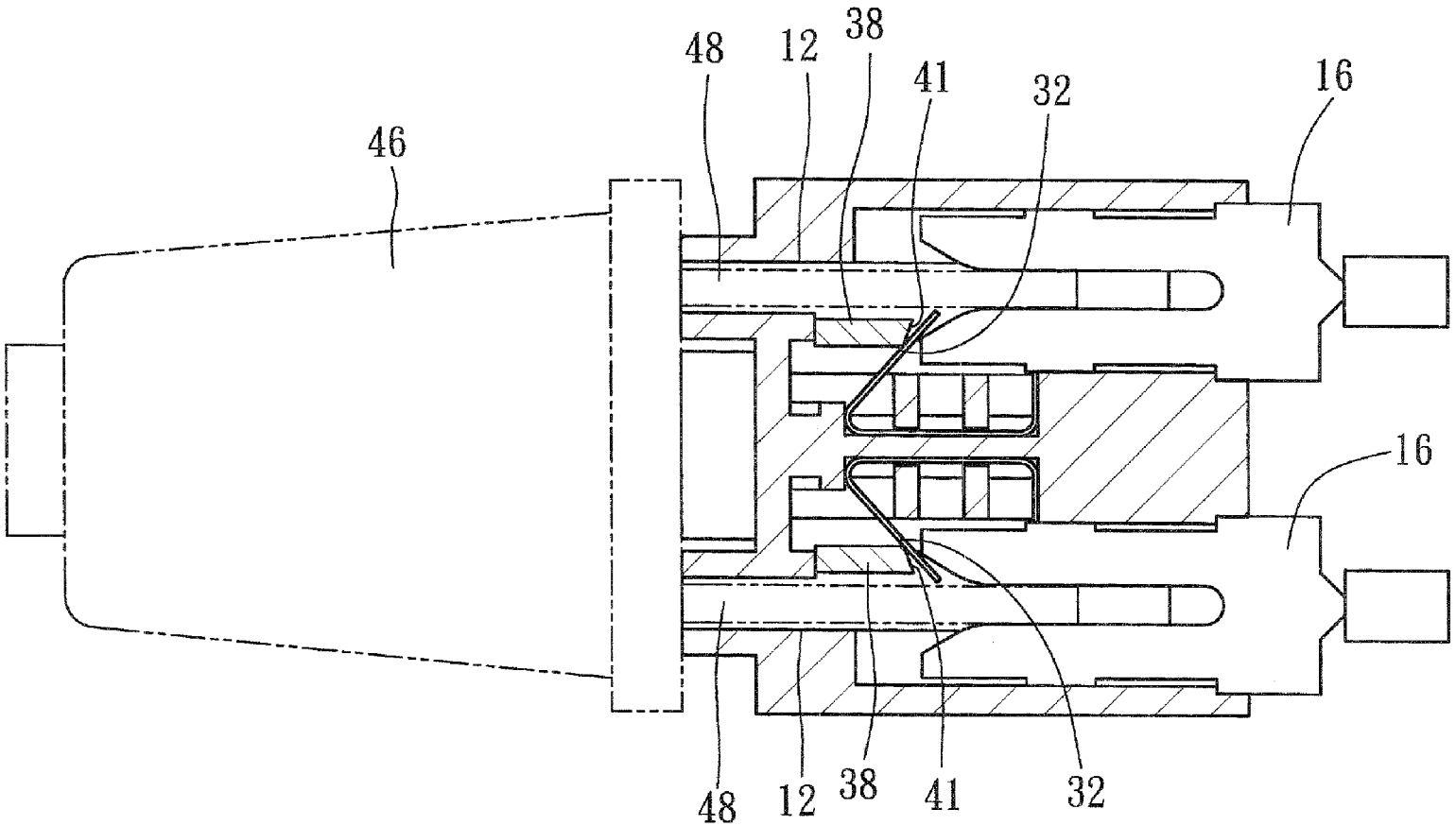
FIG. 6 is a sectional view of the referred embodiment of the present invention, showing the action of the release device on the check securing devices.

If one needs to pull the plug 46 out, he/she has to press the release device 34 first. As shown in FIG. 6, when the manipulative portion 36 is pressed, the arms 38 will be moved downwards to have the inclined faces 41 touching the flexible sections 32 of the check securing devices 28 and bend them inwards further that the flexible sections 32 will no longer contact the prongs 48, or at least the flexible sections 32 will not be moved by the prongs 48. As a result, the prongs 48 may be drawn out of the apertures 12 without any interference.

In conclusion, the present invention provides the check securing devices 28 having the flexible sections 32 with specific sloping directions that the plug 46 only may be inserted into the socket but be pulled that the plug is secured therein to prevent it from being pulled out unexpectedly. To pull the plug out, it only has to press the release device. The present invention completes a simple structure and an easier operating mode for the electric socket capable of securing the plug inserted therein.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. An electric socket, comprising:

an insulating main member having apertures thereon and electrodes behind the apertures;

at least a check securing device, which is provided in said insulating main member, having a suspended flexible section sloping toward a bottom end of said aperture and having a free end thereof received in said aperture;

wherein when a plug has prongs inserted into said apertures, the prongs will bend said flexible section of said check securing device inwards, and an interference condition will occur between the prong and said flexible section when the plug is pulled out; and a release device provided on said insulating main member, wherein said release device is manipulative to press said flexible section of said check securing device for releasing the interference condition between the prong and said flexible section;

wherein said release device has a manipulative portion and at least an arm on a back side of said manipulative portion, further wherein said manipulative portion is left out of said insulating main member, and said arm enters said insulating main member and has an inclined face to press said flexible section of said check securing device when said manipulative portion is pressed.

2. The electric socket is claimed in claim 1, wherein said free end of said flexible section of said check securing device is rough.

3. The electric socket as claimed in claim 1, wherein said release device is moved to bend said flexible section of said check securing device inwards.

4. The electric socket as claimed in claim 1, further comprising a spring urging said insulating main member and said manipulative portion of said release device.

5. The electric socket as claimed in claim 1, wherein said insulating main member has a bore and a lid close said bore, further wherein said lid has at least a hole for entrance of said arm of said release device.

6. The electric socket as claimed in claim 5, wherein said arm of said release device has a hook.

* * * * *